US005552265A

United States Patent [19]

Bredoux et al.

[11] Patent Number: 5,552,265

[45] Date of Patent: Sep. 3, 1996

[54] REVERSAL COLOR PHOTOGRAPHIC MATERIAL WITH A FINE GRAIN SUBLAYER

[75] Inventors: Francois J. Bredoux, Colnand; Maurice E. Pfaff, Le Perreux-Sur Marne, both of France

[73] Assignee: Eastman Kodak Company, Rochester, N.Y.

[21] Appl. No.: 291,248

[22] Filed: Aug. 16, 1994

Related U.S. Application Data

[63] Continuation of Ser. No. 971,916, filed as PCT/EP91/01235, Jul. 2, 1991, abandoned.

[30] Foreign Application Priority Data

Jul. 4, 1990 [FR] France ..... 90 08785

[51] Int. Cl.[6] ..... G03C 7/46

[52] U.S. Cl. ..... 430/379; 430/503; 430/504; 430/567

[58] Field of Search ..... 430/504, 503, 430/567, 379

[56] References Cited

U.S. PATENT DOCUMENTS

| | | | |
|---|---|---|---|
| Re. 28,760 | 4/1976 | Marchant et al. | 96/74 |
| 2,376,202 | 5/1945 | Staud | 95/2 |
| 3,206,313 | 9/1965 | Porter et al. | 96/108 |
| 3,505,068 | 4/1970 | Beckett et al. | 96/68 |
| 3,728,121 | 4/1973 | Zorn et al. | 96/74 |
| 3,790,384 | 2/1974 | Oishi et al. | 96/74 |
| 4,513,079 | 4/1985 | Sakanone | 430/502 |
| 4,626,498 | 12/1986 | Shuto et al. | 430/379 |
| 4,675,274 | 6/1987 | Ueda et al. | 430/379 |
| 4,978,606 | 12/1990 | Ohki et al. | 430/566 |
| 5,196,293 | 3/1993 | Okamura et al. | 430/544 |

FOREIGN PATENT DOCUMENTS

| | | |
|---|---|---|
| 114306 | 8/1984 | European Pat. Off. . |
| 155814 | 9/1989 | European Pat. Off. . |
| 2008905 | 1/1970 | France . |
| 1942079 | 8/1969 | Germany . |
| 1027146 | 4/1966 | United Kingdom . |

OTHER PUBLICATIONS

Japanese Patent Appln. 62–187839 Abstract, Patent Abstracts of Japan, vol. 12, No. 42, p. 663 (2889).

Japanese Patent Appln. 58–145941 Abstract, Patent Abstracts of Japan, vol. 07, No. 2672, p. 238 (1407).

*Primary Examiner*—Geraldine Letscher

*Attorney, Agent, or Firm*—Sarah Meeks Roberts

[57] ABSTRACT

The invention relates to a reversal color photographic print material.

Said reversal material comprises a support with, in order, a substantially light-insensitive fine grain emulsion layer which does not take part in the image formation, a red-sensitive emulsion layer having associated therewith a cyan-forming compler, a green-sensitive emulsion having associated therewith a magenta-forming coupler, a blue-sensitive emulsion having associated therewith a yellow-forming coupler.

This arrangement allows to adjust the shape of the characteristic curve of red, green, blue-sensitive emulsion layers.

6 Claims, No Drawings

REVERSAL COLOR PHOTOGRAPHIC MATERIAL WITH A FINE GRAIN SUBLAYER

This is a Continuation of application Ser. No. 971,916, filed 12 Mar. 1993 (PCT/EP91/01235 filed 02 July 1991), now abandoned.

The present invention relates to a reversal color photographic print material.

The silver halide materials, including reversal materials, for the color reproduction, generally include blue, green and red-sensitive elements, which respectively provide the yellow, magenta and cyan components of the subtractive synthesis of the color image.

The reversal materials are those, which after being exposed, are subjected to a silver development of the latent image (black and white development), and to a reversal, which renders developable the unexposed residual silver halides by means of a fogging exposure or a chemical treatment. These fogged silver halides are color developed, in the presence of a color developing agent and a coupler, this latter being generally incorporated into the reversal material.

One way to evaluate the quality of such a reversal material consists in examining the reversal characteristic curves indicating the variation of the colored density of each yellow, magenta and cyan component versus Log(E) exposure.

Those skilled in the art know that the three characteristic curves of a reversal color photographic material must be matched in order to be substantially superimposed. When the characteristic curves are not completely matched, defects in the resulting color image can occur. Particularly, the neutral values cannot be obtained in the whole useful range of the characteristic curve.

These defects can be particularly objectionable if gaps between the characteristic curves occur in the high initial exposure zones, which correspond to the minimum densities (Dmin) of the colored components. These defects may have various origins, for example developability differences in the emulsions of the different elements, absorption and adsorption characteristics of the sensitizing dyes, the unwanted stain resulting from the non correct bleaching of residual silver, the unwanted absorptions of dyes formed by coupling, etc.

It was particularly observed that the yellow and magenta characteristic curves of some reversal materials could exhibit too high Dmin. On the prints, this results in undesirable stains which are particularly objectionable as they appear in the light zones of the print. The first possibility which comes to one's mind to overcome this drawback would consist in readjusting the yellow and magenta Dmin, lowering them to the cyan Dmin value. However, according to the present invention, it was found more advantageous to readjust the cyan Dmin, although it inherently exhibits a correct value, in order to increase it up to the yellow and magenta Dmin value.

This result is obtained according to the present invention, by adding in the reversal material a sublayer located under the red-sensitive emulsion which is the outermost from the exposure face (and thus, the nearest from the support) and formed of a light insensitive non-image forming emulsion comprising fine grains. The useful emulsions according to the invention are formed of silver halide grains having a diameter less than 0.5 μm, preferably less than 0.3 μm and more preferably ranging from 0.05 to 0.2 μm.

Various uses of the fine grain emulsions are well known. In the color photographic materials, for example, Lippmann emulsion interlayers were used in order to prevent the diffusion of the sensitizing dyes from one layer to another (U.S. Pat. No. 2,376,202) or to avoid the interimage effects produced by the iodide ions (U.S. Pat. No. 3,790,384).

It was also proposed to associate light insensitive fine grain emulsions with the yellow dye forming blue-sensitive layers, in reversal materials; these emulsions, which can be in layers adjacent to the blue-sensitive emulsion layers, provide according to the prior art teaching, various improvements of the image quality and a better processing stability (European Patent 155,814). U.S. Pat. No 4,513,079 proposes to associate a fine grain emulsion to the red-sensitive cyan forming layer of a color photographic negative-positive-material; the presence of the fine grain emulsion tends to improve the speed-grain position of the cyan-forming layer when specific cyan couplers with an ureido moiety are used. These fine grain emulsions are not Lippmann emulsions and this patent does not mention the aforesaid problems associated with the characteristic curves of the dyes.

The present invention relates to a reversal color silver halide photographic material comprising:

a support having thereon, in the order, at least one red-sensitive emulsion layer having associated therewith a cyan-forming coupler, at least one green-sensitive emulsion layer having associated therewith a magenta-forming coupler, at least one blue-sensitive emulsion layer having associated therewith a yellow-forming coupler, characterized in that, between the support and the red-sensitive emulsion layer, is positioned a substantially light insensitive silver halide emulsion layer comprising fine grains having a diameter less than 0.5 μm. As shown in the examples below, the presence of this fine grain emulsion layer allows to adjust the characteristic curves of the yellow, magenta and cyan dyes, increasing the cyan Dmin to adjust it to the yellow and magenta Dmin. This fine grain emulsion is formed of grains having preferably a diameter less than 0.3 μm and more advantageous results are obtained with silver bromide or chlorobromide fine grain emulsions which grains have a diameter ranging from 0.05 to 0.2 μm, or even finer, e.g. as fine as 0.01 μm. Lippmann emulsions can particularly be used. The emulsions of this type exhibit a relatively low light sensitivity, i.e. when the photographic material is used in a conventional reversal process, they cannot record any image.

Preferably, the silver amount present in this fine grain layer is not higher than 0.5 mg/dm$^2$ and more preferably is not higher than 0.1 mg/dm$^2$.

The optimal thickness of the fine grain layer can be easily determined by someone skilled in the art depending on this layer characteristics and the coating parameters. Preferably, it ranges from 0.5 to 2.5 μm.

The fine grain layer can optionally contain common additives such as surfactants, lubricants, keeping agents, antihalation agents, for example dyes or colloidal silver, hardeners, etc.

In the reversal color photographic material according to the invention, the emulsions are preferably monodisperse emulsions, the grain size of which varies depending on the desired speed and other characteristics. The monodispersibility of an emulsion is defined as follows:

In the present disclosure, monodisperse emulsions are emulsions having a grain size distribution or variation coefficient (COV) equal to or less than 20%. The variation coefficient is represented by the formula:

$$COV = \frac{\sigma}{D} \times 100$$

wherein σ is the standard deviation and D the average grain size, represented by the average diameter when the grains are spherical and by the average value of diameters of circular images having the same surface as the grain projected images, when the grains are not spherical. For example, monodisperse emulsions can be prepared by double run precipitation in presence of a silver halide solvent such as a thioether, a thiourea or a thiocyanate. Core-shell emulsions can also be used, having a different halide composition in the core and the shell. Such emulsions were disclosed, for example, in U.S. Pat. Nos. 3,206,313 and 3,505,068 and in French Patent 1,367,941. The grains can include silver bromide, silver chlorobromide or silver chloroiodobromide. The grain shape can be any of the cubic, octahedral, tetrahedral, tabular shapes, etc. The emulsion can be precipitated in presence of a metal salt, as mentioned in *Research Disclosure*, Dec. 1989, item 08119, paragraph ID.

In a preferred embodiment, the monodisperse emulsions are silver bromoiodide octahedral core-shell emulsions having a total iodide content less than 10 mole %, preferably from 3 to 5 mole %, the shell being preferably free from iodide. The emulsions can be doped with noble metal salts of group VIII of the Periodic Table, such as iridium.

The monodisperse emulsions can be chemically sensitized, as indicated in *Research Disclosure*, Dec. 1989, item 308119, paragraph IIIA and spectrally, as indicated in the same reference, paragraph IV.

Each element of a material according to the invention, sensitized to the same region of the visible spectrum, can comprise two emulsions, or even three emulsions, with different speeds, i.e. a fast and a slow emulsion or a fast, a medium and a slow emulsion. These emulsions are blended in a single layer or incorporated into separate layers.

In an embodiment according to the invention, the emulsions can be polydisperse and optimally sensitized. In a preferred embodiment, the faster blue and green sensitive emulsions are polydisperse emulsions which are optimally sensitized.

The polydisperse emulsions can be associated to one or more slower monodisperse emulsions. The proportions and the speed of each emulsion are adjusted depending on the shape of the sensitometric curve which is desired, i.e. the contrast desired in every portion of the curve.

Moreover, the photographic material according to the invention can contain antifogging agents and stabilizers such as those disclosed in *Research Disclosure*, Dec. 1989, item 308119, paragraph VI, brighteners such as those disclosed in paragraph V, plasticizers and lubricants such as those disclosed in paragraph XII, matting agents such as those disclosed in paragraph XVI, hardeners such as those disclosed in paragraph X, absorbing and diffusing compounds such as those disclosed in paragraph VIII.

It also contains dye-forming compounds or couplers such as those disclosed in paragraph VII of the same publication. The reversal print material according to the present invention includes reflective supports conventionally formed of coated paper, as disclosed, e.g. in the above mentioned reference, paragraph XVII, C.

The following examples illustrate the invention.

EXAMPLES 1–3

On a polyethylene coated paper support were coated, in the order:

1—a gelatin layer (20 mg/dm$^2$)

2—a silver bromoiodide emulsion layer (Ag: 2.25 mg/dm$^2$; gelatin: 13 mg/dm$^2$) containing 3.7 mol % iodide, and 4 mg/dm$^2$ of the cyan coupler represented by the formula below 3—a gelatin overlayer (8 mg/dm$^2$).

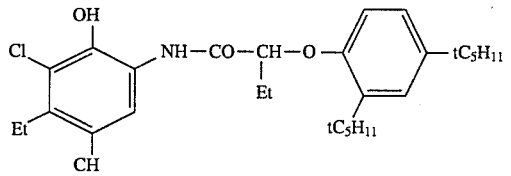

Two other similar samples were prepared, except they contained in a sublayer a substantially light insensitive fine grain emulsion containing 0.2 mg and 0.4 mg of silver per dm$^2$ respectively, as well as 20 mg/dm$^2$ of gelatin. The fine grain emulsion was a silver bromide emulsion of the Lippmann type, (grain diameter <0.10 μm), prepared according to the procedure disclosed in Chimie et Physique Photographiques, of P. Glafkides, 4th edition, page 481.

Each sample was exposed to the light of a tungsten lamp through a Kodak Wratten 15 filter and they were processed according to Kodak Ektachrome R-3 processing for Ektachrome Reversal material, comprising the following steps:

| | |
|---|---|
| Black and white development | 1 mn 15 |
| Washing | 1 mn 30 |
| Reexposure | 2 mn 15 |
| Color-forming development (38° C.) | |
| Washing | 0 mn 45 |
| Bleaching-fixing | 2 mn |
| Washing | 2 mn 15 |

The following data were obtained:

| Lippmann layer mgAg/dm$^2$ | 0 | 0.2 | 0.4 |
|---|---|---|---|
| | 0.09 | 0.21 | 0.35 |
| 0.4 TD * | 0.22 | 0.34 | 0.44 |
| 0.8 TD * | 0.10 | 0.23 | 0.36 |

* Densities obtained, performing from D = 0.8, translations of 0.4 log E and 0.8 log E respectively. The densities are measured in status A by reflection.

Densities obtained, performing from D =0.8, translations of 0.4 log E and 0.8 log E respectively. The densities are measured in status A by reflection.

These data show the density increase obtained in the curve toe resulting from the presence of the Lippmann emulsion layer.

We claim:

1. A reversal color silver halide photographic paper comprising: a support having thereon in the order at least one red-sensitive emulsion layer having associated therewith a cyan-forming coupler, at least one green-sensitive emulsion layer having associated therewith a magenta-forming coupler, at least one blue-sensitive emulsion layer having associated therewith a yellow-forming coupler, characterized in that between the support and the red-sensitive emulsion layer is positioned a substantially light-insensitive fine grain silver halide emulsion layer comprising fine grains having an average grain size less than 0.5 μm the silver amount present in the fine grain layer being not higher than 10 mg/m$^2$.

2. A reversal color silver halide photographic material comprising: a support having thereon in the following order at least one red-sensitive emulsion layer having associated therewith a cyan-forming coupler, at least one green-sensitive emulsion layer having associated therewith a magenta-forming coupler, at least one blue-sensitive emulsion layer having associated therewith a yellow-forming coupler, characterized in that between the support and the red-sensitive emulsion layer is positioned a substantially light-insensitive fine grain silver halide emulsion layer comprising fine grains having an average grain size less than 0.5 μm the silver amount present in the fine grain layer being not higher than 50 $mg/m^2$, the fine grain silver halide emulsion layer increasing cyan Dmin upon reversal processing relative to the reversal color silver halide photographic material not having the fine grain silver halide emulsion layer.

3. The photographic material according to claim 2 wherein the support is a paper support.

4. The photographic material according to claim 2 wherein the fine grain emulsion has an average grain size in the range of 0.01–0.3 μm.

5. The photographic material according to claim 3 wherein the fine grain emulsion has an average grain size in the range of 0.05–0.2 μm.

6. The photographic-material of claim 2 wherein the silver amount present in the fine grain layer is not higher than 10 $mg/m^2$.

* * * * *